United States Patent [19]

Dilley

[11] 4,194,780

[45] Mar. 25, 1980

[54] GUTTER CLEANER TOOL

[76] Inventor: Charles A. Dilley, 1624 Franklin Ave., Cleveland Heights, Ohio 46808

[21] Appl. No.: 939,430

[22] Filed: Sep. 5, 1978

[51] Int. Cl.[2] ..... A47F 13/06

[52] U.S. Cl. ..... 294/19 R; 15/236 R

[58] Field of Search ..... 294/19 R, 55, 22; 15/104.3, 236 R, 144 R, 144 B, 145, 160, 143 B; 401/9

[56] References Cited

U.S. PATENT DOCUMENTS

| | | | |
|---|---|---|---|
| 3,626,542 | 12/1971 | Despain et al. | 294/19 R |
| 3,858,267 | 1/1975 | Swannie | 294/19 R |

*Primary Examiner*—James B. Marbert

*Attorney, Agent, or Firm*—Baldwin, Egan, Walling & Fetzer

[57] ABSTRACT

A device is described for cleaning leaves and other debris from common house gutters, consisting of a pole handle, to each end of which is attached a simple tool consisting of two arms mounted at right angles to the handle and 180 degrees apart. On the end of each arm is a paddle shaped roughly like the bottom of the gutter. About six inches from the pole, one of the arms is offset some three inches toward the operator. The paddle attached to this arm is smaller in height than that attached to the other.

In operation, the paddle on the straight arm pulls the leaves down the gutter until it reaches a cross-strut. The operator then rotates the handle 180 degrees permitting the offset arm and the smaller paddle to pull the leaves under the cross-strut. The operator then rotates the handle back to its original position so that it can insert the paddle of the straight arm into the gutter on the near side of the cross-strut but behind the pile of leaves, and repeats the procedure until all the debris has been brought to the operator and lifted from the gutter.

3 Claims, 3 Drawing Figures

GUTTER CLEANER TOOL

An arduous and dangerous task of the homeowner is the cleaning of leaves and other debris from the gutters of his residence every spring and fall. One of the obstacles to such cleaning operation are the cross-struts (large spikes and collars) which are used every few feet along the length of a gutter to attach the gutter to the house and strengthen the outer wall of the gutter with respect to the inner wall thereof.

The objective of the present invention is to provide a simple tool to facilitate the removal of leaves and other debris (such as seed pods, in the spring) from ordinary house gutters. This objective is achieved because this invention gives the operator three advantages not previously experienced. They are:

1. a triple or quadruple extension of reach in each direction (from about 8 ft. to about 32 ft. per ladder position)

2. a corresponding reductions in ladder positions, about one quarter as many as before 3. a substantial reduction in the time and cost required for the operation.

Since the typical American home is a two-story structure, with gutters some 20 feet off the ground, the typical operation requires the use of an extention ladder, fully extended. Ladders in this position can be very dangerous. Lightweight ladders are usually too flimsy, while substantial ladders are very heavy. Heavy ladders, in extended position, have such a high center of gravity that a delicate balancing act is required to move them from position to position. This is particularly true when they must be moved around large bushes and trees, used in landscaping. While it is possible to secure the ladder firmly, this is less likely to happen when the ladder is being moved around for short stops. Consequently, cleaning gutters is one of the more dangerous chores around the average home. Many men have been seriously injured and even killed by falling off ladders for cleaning gutters because they were too hurriedly placed, or the operator was reaching too far.

Other objects and advantages of the present invention will be apparent from the accompanying drawings and description and the essential features will be set forth in the appended claims.

In the drawings,

FIG. 2 is a side elevational view showing the device of FIG. 1 including a pair of paddles at opposite ends of one handle, if desired, for use with this invention; while

Figure 1:
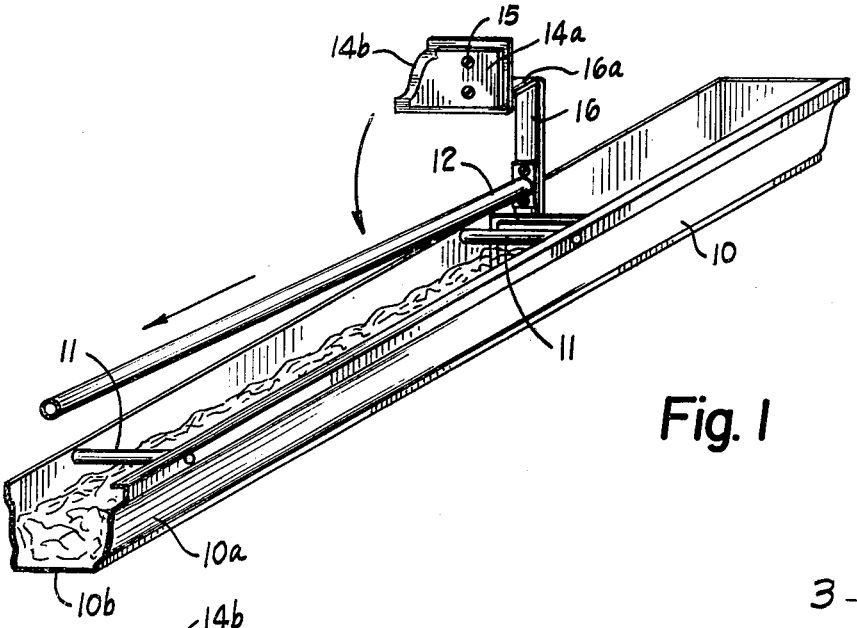
FIG. 1 is a perspective view showing a portion of a residential gutter which is usually attached to the eaves of the house roof. The tool of this invention is shown in an operating position in the gutter.

In illustrating this invention, a portion of a gutter 10 is shown as it is usually attached to the eaves of a residential roof. It is well known that such gutters have many cross-struts 11, consisting of long spikes inside metal collars, along the length thereof. These cross-struts have a dual function. The long spikes are driven through the top of both walls of the gutter and into the house (immediately under the roof) thus securing the gutter to the house, while the metal collars separate the gutter walls from each other, pin the inside walls firmly against the house and pinch the outside walls firmly against the heads of the spikes. The side walls **10*a* and the bottom 10*b*** of the gutter are usually formed out of one piece of sheet metal.

The simple tool of this invention comprises an elongated handle 12 to one end of which is attached rigidly one arm 13 at right angles to handle 12 which extends a sufficient distance to enter the gutter and scrape the bottom and walls thereof when the handle 12 is held above and parallel to the gutter. In one embodiment of this invention that is about four and one-half inches from the center of the handle 12 to the lower end of the arm 13. Rigidly fastened on the outer end of the arm 13 is a first paddle 14. This paddle is here shown as comprising parallel metal plate members **14*a* on opposite sides of a scraping member 14*b* which preferably is of rubber or plastic sufficiently stiff to push leaves along the length of the gutter. This paddle is rigidly fastened as by bolts 15 to the arm 13 and plates 14*a*. The paddle is here shown as roughly having the same contour as the interior walls of the gutter 10**. However, a fairly good job could be accomplished by a paddle which generally conformed to the interior shape of the roof gutter.

A second arm 16 is rigidly fastened to the handle 12 and extends at right angles away from the handle generally in vertical line with the arm 13. In the preferred form shown in the drawings, it is one length of stiff metal which forms both arms 13 and 16 but this would not necessarily be so. The arm 16 extends at right angles for approximately the same length as the arm 13 and then is bent at right angles for an offset portion **16*a* which extends parallel to the handle 12 and toward the operator's end of the handle for a few inches. In one preferred embodiment of this invention, the portion 16*a* is about three inches long, then the member 16 and 16*a* again turns vertically upward as shown at 16*b*, and here there is attached another, or offset, paddle 14', similar, but sufficiently lower or smaller in height, than that described at 14 so that it can be pulled under the cross-struts. This includes plate members 14*a'* supporting between them a scraper member 14*b'* by means of bolts 15'** as previously described.

Figure 2:
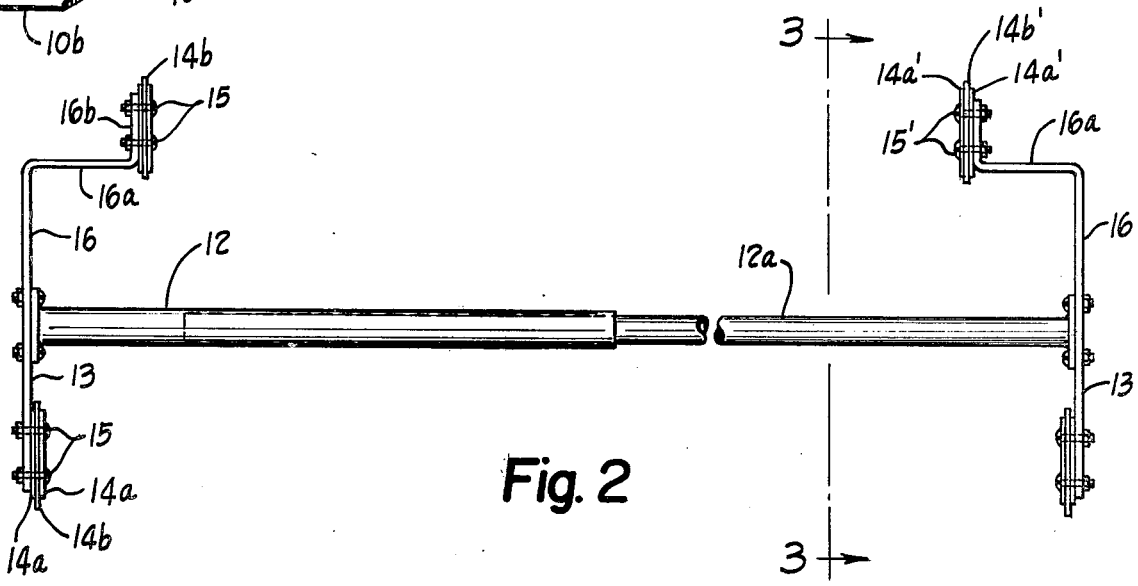
Figure 3:
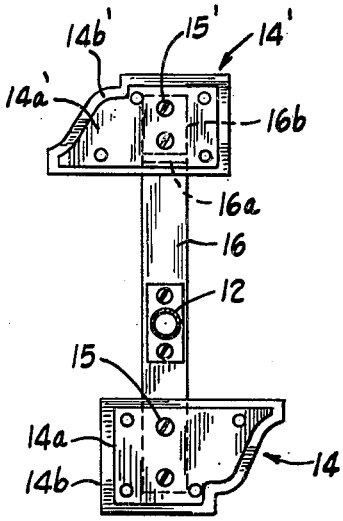
FIG. 3 is an elevational view taken along the line 3—3 of FIG. 2.

In practice, the tool thus far described could be used by itself but FIG. 2 shows a combined handle including the parts 12 and **12*a* and on the ar end of the handle 12*a* there is supported a double arm paddle structure 13', 16' which is exactly like that described at the other end of the handle 12**, but with the mounting reversed as to left and right. Similar parts are given similar reference characters with a prime suffix.

In the drawings, the arm supports 13 and 16 are oriented 180 degrees from each other and this is the preferred form. However the angle of orientation must be such that one arm may enter its paddle into a gutter without interruption with the other paddle or with a roof supporting the gutter.

The irregular line 17 is to illustrate the position of the leaves in the gutter 10.

In operation of this gutter cleaning tool, the operator grasps the handle 12 and holding it generally parallel to the gutter 10 above the same he inserts the lower paddle 14, as seen in FIG. 2 at the left, into the gutter where he can drag it along the bottom wall **10*b*. When the arm 13 strikes the strut 11 as shown in FIG. 1, the operator rotates the handle 12 180 degrees causing the other paddle 14' on arm 16 to enter the gutter 10 and pull the leaves under the cross-strut. He then rotates the handle back to its original position and places the "straight" paddle 14 on the left or near side of the cross-strut. Thereafter, the operator can draw the tool toward the left as viewed in FIG. 1 until the arm support 13 strikes the strut 11 shown at the left end of FIG. 1. Here, the paddle 14' located on the arm 16 is again rotated to push the leaves a few inches to the left of the strut 11 at the left end of FIG. 1, after which the operator again rotates the handle 12 causing the arm support 13 to enter the gutter 10 on the lefthand side of the strut 11 as seen in FIG. 1** and so on down the length of the entire gutter.

The paddles 14 and 14' could be alike if each had a vertical height to pass under the struts 11, but 14 is here shown a little taller to carry more leaves along.

It is well known that in cleaning roof gutters using known tools, the greatest effort is that caused by having to move a tall ladder from place to place along the gutter, cleaning as far as one can reach at each spot. This invention greatly eases the job because one will move the ladder only a few times.

What is claimed is:

1. A gutter cleaning tool comprising a rigid handle extending longitudinally, a first arm fixed to one end of said handle and extending at right angles thereto, a first straight paddle fixed at the outer of said arm at right angles to said handle, said paddle generally conforming to the interior shape of a roof gutter, a second arm fixed to the same end of said handle and extending at right angles thereto and then bending at right angles to extend parallel to said handle for a short distance toward the operator's end of said handle and there supporting a second offset paddle at right angles to said handle, said arms being fixed at an angle of orientation, one to the other, such that one arm may enter its paddle into a gutter without interruption with said other paddle or with a roof supporting said gutter, whereby an operator may hold said handle generally parallel to a gutter with said straight paddle entered into said gutter and may pull said paddle in one direction longitudinally until a cross-strut in said gutter is engaged on one side, whereupon the operator may rotate said handle to lift said straight paddle out of said gutter and to cause said offset paddle to enter into said gutter on the same side of said cross-strut and pull the leaves under the cross-strut to the opposite side, after which the operator may rotate the handle to insert said straight paddle on said opposite side back of the leaves and so move along said gutter.

2. A gutter cleaning tool as defined in claim 1, wherein said angle of orientation is 180 degrees.

3. A gutter cleaning tool as defined in claim 1, wherein the vertical height of said offset paddle will permit it to pass under a cross-strut.

* * * * *

UNITED STATES PATENT OFFICE

CERTIFICATE OF CORRECTION

Patent No. 4,194,780 Dated March 25, 1980

Inventor(s) CHARLES A. DILLEY

It is certified that error appears in the above-identified patent and that said Letters Patent are hereby corrected as shown below:

On the title page, item (76), cancel "1624 Franklin Ave." and insert -- 2371 Woodmere Drive --. Cancel "46808" and insert --44106--.

Signed and Sealed this

*Thirtieth* Day of *December 1980*

[SEAL]

*Attest:*

SIDNEY A. DIAMOND

*Attesting Officer*

*Commissioner of Patents and Trademarks*